US005401108A

United States Patent [19]

Debreczenyi

[11] Patent Number: 5,401,108

[45] Date of Patent: Mar. 28, 1995

[54] IMPROVED INK RETAINING MASS FOR REINKING RIBBONS IN INK CARTRIDGES

[76] Inventor: Frank M. Debreczenyi, 9145 Kopping La., Hickory Hills, Ill. 60457

[21] Appl. No.: 56,242

[22] Filed: Apr. 30, 1993

Related U.S. Application Data

[63] Continuation-in-part of Ser. No. 640,641, Jan. 14, 1991, Pat. No. 5,207,519.

[51] Int. Cl.[6] ..... B41J 27/12

[52] U.S. Cl. ..... 400/202.4; 400/202; 400/208

[58] Field of Search ..... 400/197, 200, 201, 202, 400/202.1, 202.2, 202.3, 202.4, 207, 208

[56] References Cited

U.S. PATENT DOCUMENTS

| | | | |
|---|---|---|---|
| 1,365,737 | 1/1921 | Simpson | 400/200 |
| 1,832,007 | 11/1931 | Eckland et al. | 400/202.4 |
| 2,508,780 | 5/1950 | Von Duyke | 400/202.4 |
| 2,904,157 | 9/1959 | Smith | 400/202.1 |
| 3,175,780 | 3/1965 | Nettles | 400/202.1 |
| 3,460,665 | 8/1969 | Dodsworth et al. | 400/201 |
| 3,904,015 | 9/1975 | Boyden et al. | 400/202.4 |
| 3,918,569 | 11/1975 | Parker | 400/202.4 |
| 4,289,413 | 9/1981 | Seplin | 400/202.4 |
| 4,449,838 | 5/1984 | Okamura et al. | 400/202.4 |
| 4,469,457 | 9/1984 | Chida et al. | 400/202.4 |
| 4,536,098 | 8/1985 | Sheehan et al. | 400/202 |
| 4,636,097 | 1/1987 | Goubeaux | 400/202.4 |
| 4,653,947 | 3/1987 | Echols | 400/196.1 |
| 4,741,639 | 5/1988 | Fausto et al. | 400/202.4 |
| 5,190,385 | 3/1993 | Taguchi et al. | 400/200 |

FOREIGN PATENT DOCUMENTS

| | | | |
|---|---|---|---|
| 0167892 | 1/1986 | European Pat. Off. | 400/202.4 |
| 2591151 | 6/1987 | France | 400/202.4 |
| 56-5782 | 1/1981 | Japan | 400/202.4 |
| 59-118487 | 7/1984 | Japan | 400/202.2 |
| 295065 | 12/1986 | Japan | 400/197 |
| 292979 | 10/1992 | Japan | 400/202.4 |
| 345881 | 12/1992 | Japan | 400/202.4 |
| 547815 | 9/1942 | United Kingdom | 400/202.1 |

OTHER PUBLICATIONS

MacInker brochure.

BMS product information bulletin (Ref. #0-182) entitled: Okidata Microline 182 Fabric Cartridge With Reinker.

Turbon International brochure entitled: Cassette RI-406.00 for Printer F+/C+.

NCR 2140 brochure.

BMS product information bulletin (Ref. #1-206) entitled: IBM System 32 Model B "Harmonica" Fabric Cartridge.

Product-Info Apr. 1985 brochure (Ref. No. S 130) entitled: Shinwa SP 80.

Product-Info Apr. 1987 brochure (Ref. No. C 210) entitled: Centronics 350 IMB 4214.

IBEX II brochure entitled: The Power To Last.

Shennic Industrial Corp. brochure entitled: Shennic Ribbon Inker.

*Primary Examiner*—Edgar S. Burr

*Assistant Examiner*—Stephen R. Funk

*Attorney, Agent, or Firm*—Hill, Steadman & Simpson

[57] ABSTRACT

The invention provides an ink pad for receiving ink refills, located opposite an opening in a wall or walls of the cartridge, the ink pad can have dished surfaces to retain ink onto the ink pad to prevent spillage from the ink pad. The opening in the cartridge wall can be offset from, or alternatively made larger in diameter than, the ink pad to expose an edge of the ink pad to assist in depositing ink onto the pad and also to provide a surface for wiping a nozzle from an ink bottle. A dual compartment for holding a liquid ink supply and an ink retaining mass can also be provided, the ink retaining mass pressed to an ink transfer roller for the cartridge. Also, a two-tiered ink cartridge can be provided to increase the effective storage length of fan-folded ribbon within the cartridge, a top tier being an ink retaining mass and a bottom tier being the ribbon, with a wick for transferring ink from the mass downward to the ribbon.

15 Claims, 8 Drawing Sheets

FIG. 1
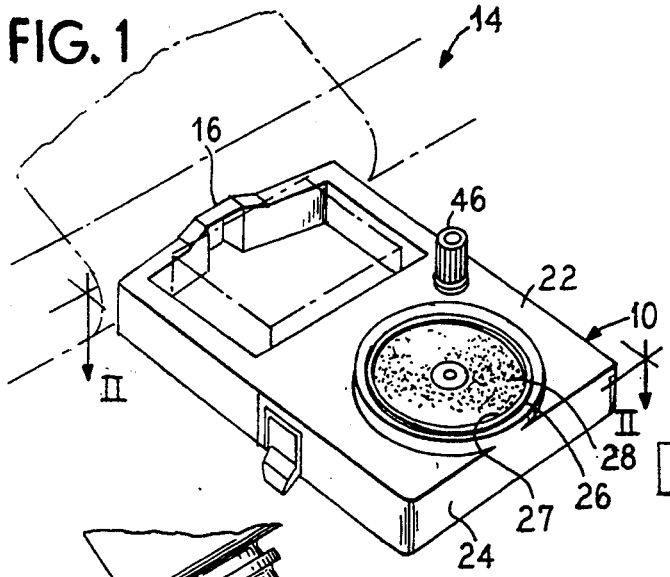
FIG. 2
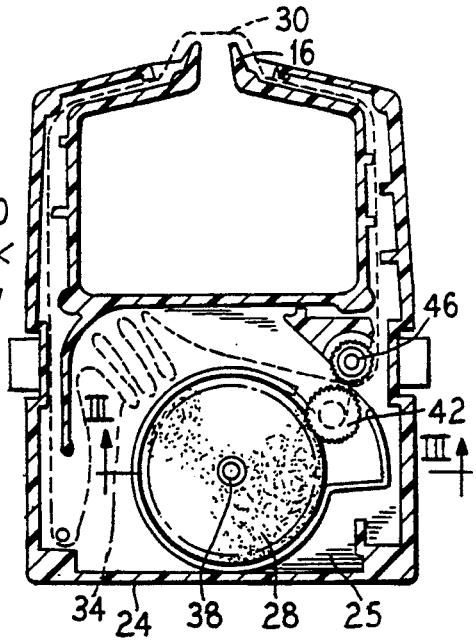
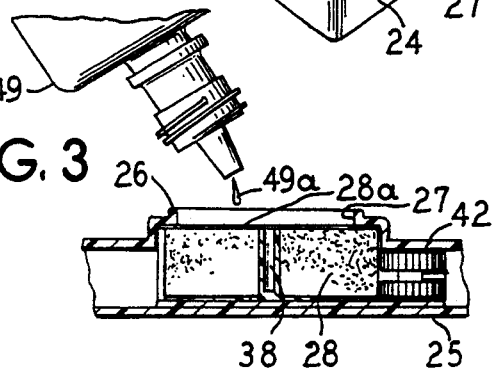
FIG. 3
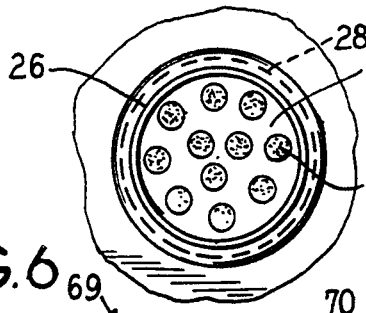
FIG. 4
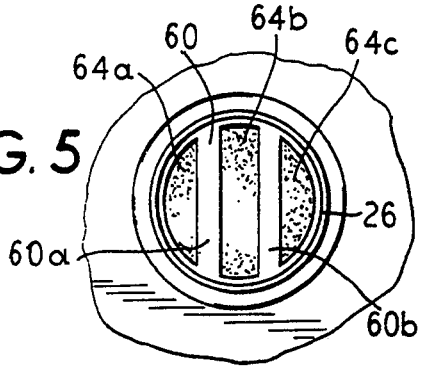
FIG. 5
FIG. 6
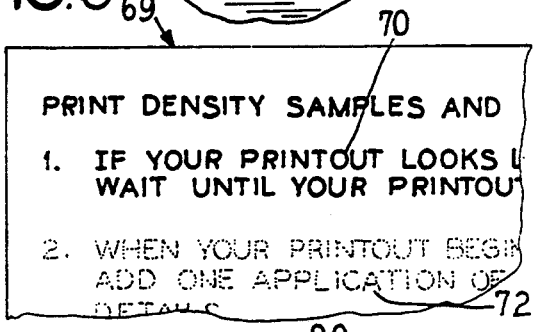
FIG. 7
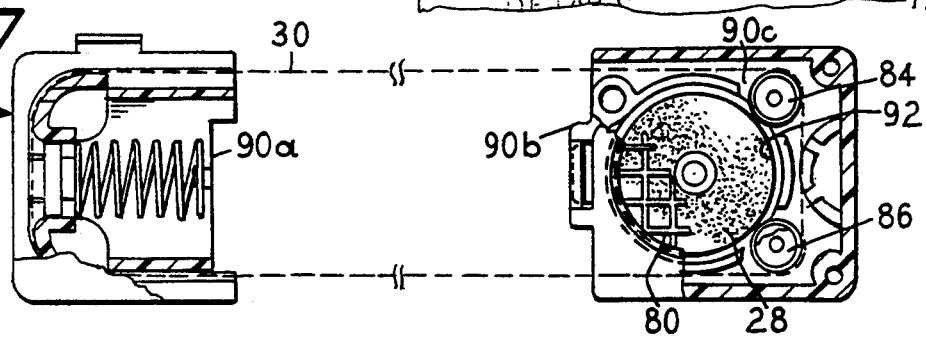

FIG. 33
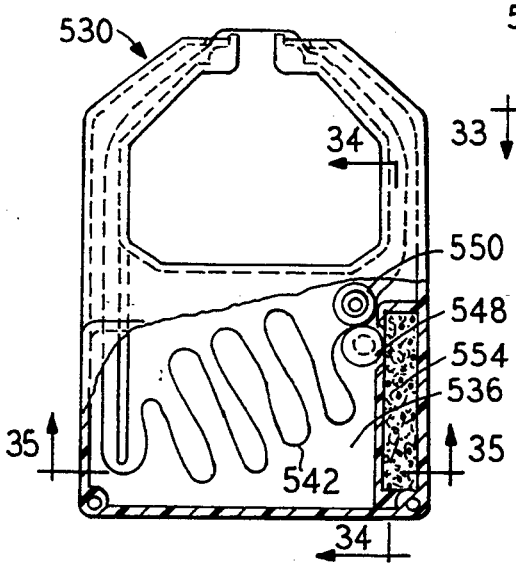
FIG. 34
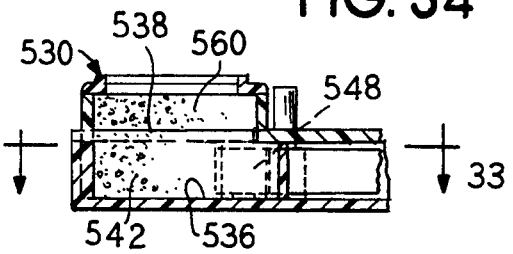
FIG. 35
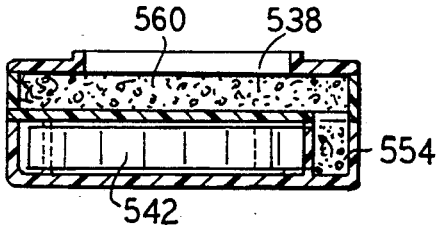
FIG. 36
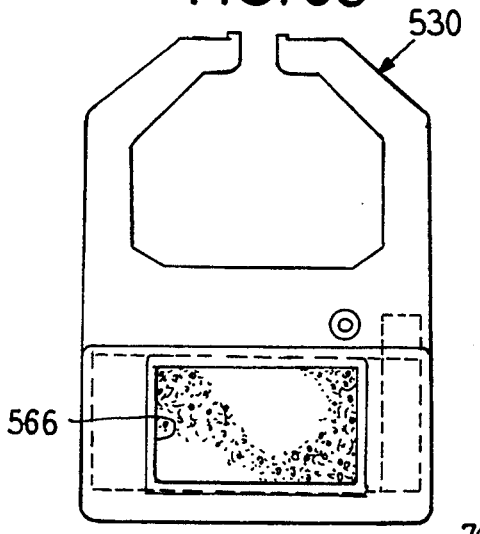
FIG. 17B
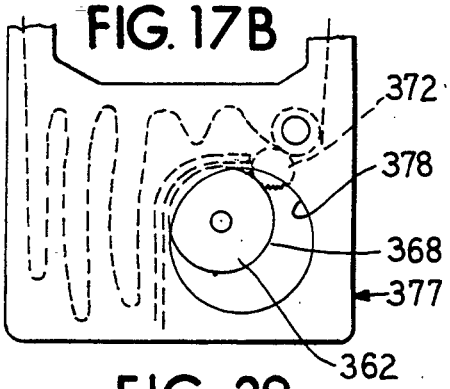
FIG. 38
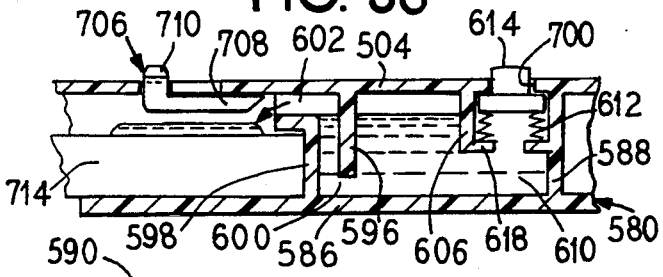
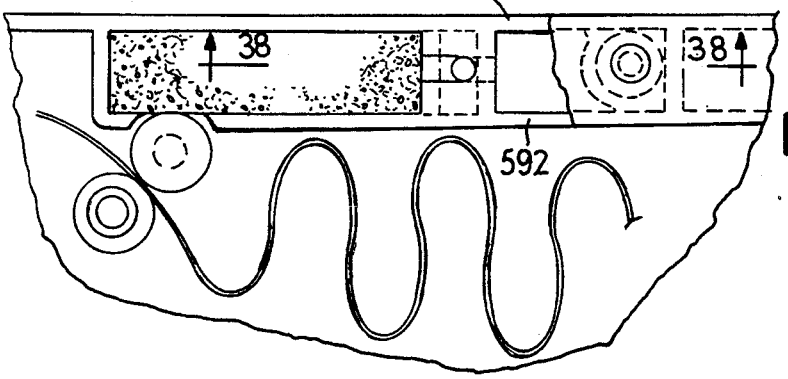
FIG. 37

FIG. 21
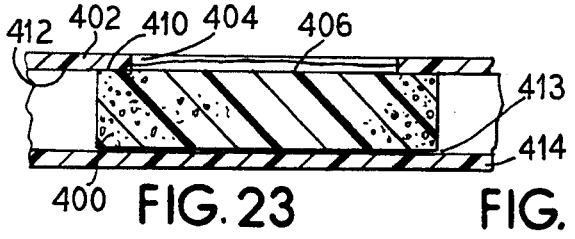
FIG. 22
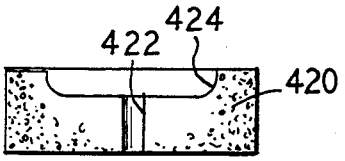
FIG. 23
FIG. 24
FIG. 25
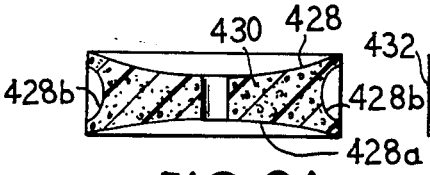
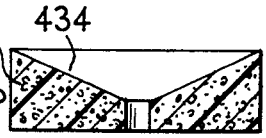
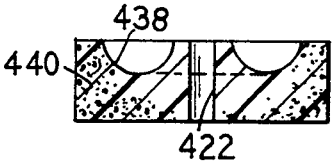
FIG. 26
FIG. 27
FIG. 28
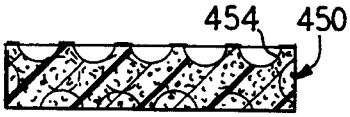
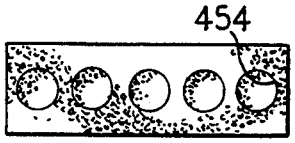
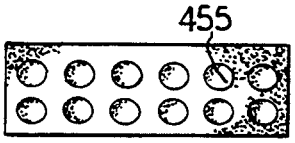
FIG. 26A
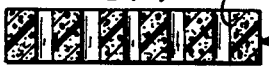
FIG. 22A
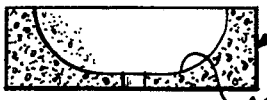
FIG. 29 PRIOR ART
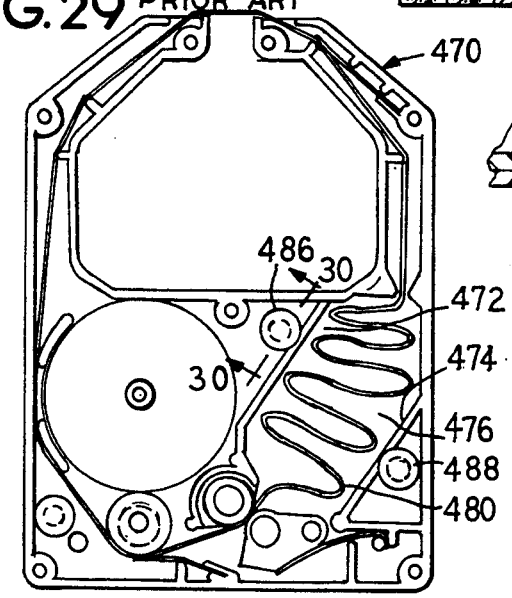
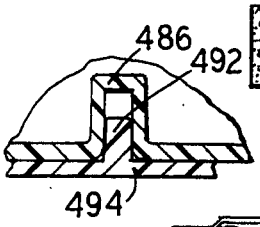
FIG. 30 PRIOR ART
FIG. 31
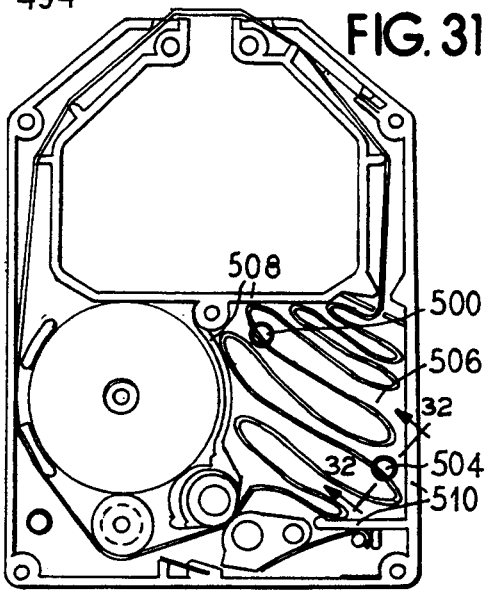
FIG. 32
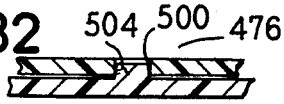
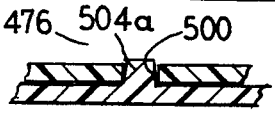
FIG. 32A

IMPROVED INK RETAINING MASS FOR REINKING RIBBONS IN INK CARTRIDGES

This application is a continuation-in-part of U.S. patent application Ser. No. 07/640,641, filed Jan. 14, 1991, and now U.S. Pat. No. 5,207,519, issued May 4, 1993.

BACKGROUND OF THE INVENTION

The present invention relates to printer ribbons and cartridges and an improvement thereof for re-inking the ribbons and cartridges and a method for so re-inking including a system to inform a printer user when re-inking is necessary. The following describes existing technologies for printer ribbons and methods available to users of the ribbons for re-inking.

Spooled Ribbons

These ribbons consist of a band or ribbon of a substrate, usually a woven nylon cloth, saturated with ink, wound on one, or more commonly two, reels or "spools". During the printing operation, the ribbon unwinds and rewinds from spool to spool, reversing direction as it gets toward the end of the ribbon, by means of a switch which is actuated by an eyelet or bar attached to each end of the ribbon, or by means of tension created when the ribbon comes to the end of the spool.

As the ink in the ribbon becomes depleted, the print gets lighter and lighter. At this point, the ribbon is generally discarded, but can be re-inked on a re-inking machine such as the MAC INKER TM automatic ribbon re-inker (patent pending).

The ribbon is removed from the printer and installed in the MAC INKER TM automatic ribbon re-inker to be re-inked. Ink is added to a felt roller which comes into contact with the substrate. The ink is transferred to the substrate by means of capillary action. After adding ink to the roller and installing the ribbon, the machine is turned on and as the ribbon unwinds from one spool and rewinds to the other spool, a small amount of ink is applied to the substrate. When the ribbon is completely unwound/rewound, a switch is actuated which shuts the machine off. Now the user or operator removes the spools from the machine and re-installs them in reverse. Then the machine is turned on again. This process is repeated up to 15 times or more before the ribbon is adequately re-inked.

There are many drawbacks to this process.

The ink in every ribbon has a lubricating effect between the substrate and the printhead which can help to minimize abrasion. When the ink is depleted during use of the ribbon, the substrate soon becomes severely worn or damaged. Re-inking a ribbon in this condition can be difficult. Also, the ribbon could snag or tear in the printer causing loss of printouts, wasted computer time (the report would have to be re-run) and possible damage to the printer or printhead.

It is extremely difficult, if not impossible, to measure how much ink is needed to obtain satisfactory yield and print quality from a ribbon which is re-inked on a MAC INKER TM automatic ribbon re-inker device. If you do not apply a sufficient quantity of ink, the yield will be poor and the ribbon will have to be removed from the printer again and re-inked in the MAC INKER TM automatic ribbon re-inker more frequently. If you apply too much ink to the ribbon, it can cause streaking and smearing on the paper. This is such a common problem, that the manufacturer of the MAC INKER TM automatic ribbon re-inker has included instructions on what to do if this occurs.

This system has no way of accurately measuring inking, is very time consuming and complicated, is prone to error by the user and can be very messy.

Cartridge Ribbon with Continuous Loop and Ink Reservoir

These ribbons come in many styles for different printers, although the basic concept and design is the same for all of them. The basic concept consists of a seamless or welded ribbon loop which is fanfolded or "stuffed" into the cartridge. The ribbon advances by means of a drive gear meshing with an idler gear, with the ribbon sandwiched between them. These internal drive gears which are built into the cartridge are driven by a mechanism in the printer which turns them, pulling the ribbon through the cartridge as it fanfolds at the same time.

The inker reservoir may consist of a felt or foam, roller or pad. The reservoir is in constant contact with the drive gear or idler gear. Ink is transferred from the reservoir to the gear(s) which in turn transfer(s) the ink to the substrate. When the ink in the reservoir is depleted, it cannot be refilled, so the ribbon is usually discarded. Re-inking the substrate or ribbon with an external re-inking device such as the MAC INKER TM automatic ribbon re-inker, without refilling the reservoir, would only extend the life of the ribbon by 2% to 5%.

The ink in the ribbon has a lubricating effect between the substrate and the printhead, which helps to minimize abrasion. Since the length of this type of ribbon is generally very short in comparison to other types of ribbons, when the ink is depleted during initial use, the substrate can become severely worn or damaged very quickly. Re-inking a ribbon in this condition can be difficult. Also, the ribbon could snag or tear in the printer causing loss of printouts, wasted computer time (the report would have to be re-run) and possible damage to the printer or printhead.

Cartridge Ribbon-Continuous Loop-Without Ink Reservoir with Internal Drive Gears or Rollers This concept or design is similar to the one described directly above except that the substrate or ribbon is generally longer, it is usually a welded loop and it does not have any ink reservoir. Since there is no ink reservoir, the print yield may be less than shorter ribbons with an ink reservoir. When the ink in the ribbon is depleted, the ribbon is usually discarded and replaced.

These ribbons can be re-inked with devices such as the MAC INKER TM automatic ribbon re-inker. The ribbon is removed from the printer and installed in a MAC INKER TM automatic ribbon re-inker which has a drive system similar to that in the printer. Ink is added to a felt roller or pad which comes into contact with the substrate. The ink is transferred to the substrate by means of capillary action. After adding ink and installing the ribbon, the machine is turned on and as the ribbon is pulled through and fanfolded into the cartridge a small amount of ink is applied to the substrate by means of contact to the external roller or pad.

There are many drawbacks to this process.

The ink in every ribbon has a lubricating effect between the substrate and the printhead which can help to minimize abrasion. When the ink is depleted during initial use of the ribbon, the substrate soon becomes severely worn or damaged. Re-inking a ribbon in this condition can be difficult. Also, the re-inked ribbon could snag or tear in the printer causing a loss of printouts, wasted computer time (the report would have to be re-run) and possible damage to the printer or printhead.

It is extremely difficult if not impossible, to measure the amount of ink needed to obtain satisfactory yield and print quality from a ribbon which is re-inked on a MAC INKER TM automatic ribbon re-inker device. If you do not apply a sufficient quantity of ink, the yield will be poor and the ribbon will have to be removed from the printer again and re-inked in the MAC INKER TM automatic ribbon re-inker more frequently.

If you apply too much ink to the ribbon, it can cause streaking and smearing on the paper. Over-inking can also cause the drive gears to slip on the ribbon as they turn. As a result, the ribbon will not advance in the printer and will jam causing possible damage to the ribbon, printhead or printer. This is such a common problem that the manufacturer of the MAC INKER TM automatic ribbon re-inker has included instructions on what to do if this occurs.

This system of re-inking provides no method of accurately measuring inking, is very time consuming and complicated, is prone to error by the user and can be very messy.

Cartridge Ribbon-Continuous Loop-Without Ink Reservoir with External Drive Gears or Rollers This concept or design is similar to the one described directly above except that the gears or rollers which pull the ribbon through and fanfold it into the cartridge are not built into the cartridge but are a part of the printer itself. There is an opening in the cartridge into which the drive gears or rollers fit when the ribbon cartridge is installed in the printer. As with other concepts, there are many different styles and variations of this design, but the basic concept is the same for all of them. When the ink in the ribbon is depleted, the ribbon is usually discarded and replaced.

These ribbons can be re-inked with a device such as the MAC INKER TM automatic ribbon re-inker. The ribbon is removed from the printer and installed in a MAC INKER TM automatic ribbon re-inker which has a drive system similar to that in the printer. Ink is added to a felt roller or pad which comes into contact with the substrate and is transferred by means of capillary action. After adding ink and installing the ribbon, the machine is turned on and as the ribbon is pulled through and fanfolded into the cartridge a small amount of ink is applied to the substrate.

There are many drawbacks to this process.

The ink in every ribbon has a lubricating effect between the substrate and the printhead which can help to minimize abrasion. When the ink is depleted during the initial use of the ribbon, the substrate soon becomes severely worn or damaged. Also, the re-inked ribbon could snag or tear in the printer, causing a loss of printouts, wasted computer time (the report would have to be re-run) and possible damage to the printer or printhead.

It is extremely difficult, if not impossible to measure the amount of ink needed to obtain satisfactory yield and print quality from a ribbon which is re-inked on a MAC INKER TM automatic ribbon re-inker type device. If you do not apply a sufficient quantity of ink, the yield will be poor and the ribbon will have to be removed from the printer again and re-inked in the MAC INKER TM automatic ribbon re-inker more frequently.

If you apply too much ink onto the ribbon, it can cause streaking and smearing on the paper. Over-inking can also cause the drive gears or rollers to slip on the ribbon as they turn. As a result, the ribbon will not advance in the printer and may cause jamming and possible damage to the ribbon, printer or printhead. This is such a common problem that the manufacturer of the MAC INKER TM automatic ribbon re-inker has included instructions on what to do if this occurs.

This system of re-inking provides no method of accurately measuring inking, is very time consuming and complicated, is prone to error by the user and can be very messy.

Parent application U.S. Ser. No. 07/640,641, filed Jan. 14, 1991, now U.S. Pat. No. 5,207,519, solved many of the aforementioned problem. However, even as to that improvement, simply providing an opening through the top of the cartridge above an ink retaining mass can have drawbacks. When a user applies too much ink, some ink may flow over the edge of the ink retaining mass and onto the ink transfer roller causing undesirable "hot spots". There can be a significant gap between the underside of the cartridge cover and the top of the ink pad or roller, even though they may actually appear to be in physical contact with each other. This gap is much greater than the size of the openings or pores in the ink retaining mass (pad or roller).

When ink is added to the pad or roller, it is absorbed very slowly. If the user adds surplus ink to the point that it touches the rim of the opening, the ink will follow the path of least resistance and flow horizontally between the pad or roller and the underside of the cover. Some of the ink will continue to flow on the underside of the cover and through any gap in the wall which separates the ink retaining mass (roller or pad) from the substrate. Some of the ink will be inadvertently deposited on random spots on the substrate causing hot spots and resulting in uneven printout. Other causes of hot spotting of ink can be:

1. accidental touching of the ink on the rim of the opening due to over applying the ink;
2. accidental touching of the tip of the bottle on the rim;
3. wiping action of the rotating ink retaining roller causing continual depositing of quantities of ink on the rim of the opening; and
4. migration of ink directly from the pad or roller due to touching of the pad or roller around the rim of the opening.

In contrast, when ink is properly transferred from the pad or roller by the roller means, the ink application is uniform or evenly distributed, i.e., no hot spots.

SUMMARY OF THE INVENTION

The present invention relates to printer ink ribbons, and in particular, printer ink cartridges. According to the invention, an improved arrangement is provided to resupply the printer cartridge with ink for applying onto the ribbon. The following describes the improvements and advantages of the proposed arrangement for re-inking printer ribbons compared to art currently available to the consumer or user.

Processing Time, Skill and Equipment Requirements

In the prior art the cartridge or ribbon must be removed from the printer and installed in an external re-inking device such as the MAC INKER TM automatic ribbon re-inker. The ribbon is then re-inked, and removed from the device to be re-installed in the printer. Other functions performed by the operator would include adding ink to the MAC INKER TM automatic ribbon re-inker ink roll or pad, visually checking operation of the machine and cleaning of the ribbon in the event that it becomes over-inked during the re-inking process. These processes can take anywhere from 15 minutes to many hours per ribbon depending on the skill or improvisational ability of the operator. In addition, the user must purchase a re-inking device from the company who supplies devices such as the MAC INKER TM automatic ribbon re-inker. These machines can be expensive. The machines take up much needed space in the office or work area. If a user replaces his printer(s), his re-inking machine may not re-ink the ribbons for his new printer(s), therefore making the re-inker obsolete.

The invention eliminates most of the steps and work required for the prior art and also eliminates the cost and space requirements of the re-inking machine. This is accomplished by making changes to the existing ribbon cartridges in a manner which allows the user to add the ink directly into the cartridge without removing it from the printer. The basic concept for the changes is the same regardless of the shape or design of the cartridge.

Ink Depletion and Lubricating Effect Between Printhead and Ribbon Substrate

The ink in every ribbon has a lubricating effect between the printhead and substrate which minimizes abrasion. In the prior art, as the ink becomes depleted, the lubricating effect is greatly diminished. Most users leave the ribbon in the printer, without re-inking it, until the print becomes relatively light, because of the inconvenience and time required in the prior art. At this point the substrate may become severely worn or damaged. Re-inking the ribbon in this condition is difficult. The re-inked ribbon may snag or tear in the printer, causing a loss of printouts, wasted computer time (the report would have to be re-run) and possible damage to the printer or printhead.

The system of re-inking using the invention prevents the depletion of ink, and therefore prevents the loss of the lubricating effect between the printhead and ribbon substrate.

When the user purchases a ribbon with the new re-inkable arrangement, he is provided with color print density charts or gauges, sample printouts and specific instructions explaining when the ribbon is to be refilled with ink. The user is generally instructed to begin adding ink to the re-inking reservoir on a regular basis after commencing use of the ribbon, in accordance with the recommendations provided.

Since refilling the reservoir with ink is not time consuming, 15–30 seconds for the invention compared to 15 minutes to many hours for the prior art, the user more readily follows the recommendations provided with the ribbon, that the ink in the reservoir shall be topped up on a regular basis and not be allowed to become depleted.

Printout Consistency

In the prior art, as the ribbon is used, the print becomes lighter and lighter as the ink is depleted. Users tend to leave the ribbon on the printer for longer periods of time before re-inking or replacing them due the time requirements, inconvenience and inconsistency of re-inking using the prior art and the high cost of replacement ribbons.

The convenience of the invention enables and motivates the user to refill the reservoir as recommended, on a regular basis, resulting in a more consistent intense or jet black printout (or other color) during the full life of the ribbon, as opposed to an intense black (or other color) fading or turning lighter as with the prior art.

Re-Inking Accuracy

Re-inking accuracy is difficult to achieve with the prior art. The ribbons may often become over-inked or under-inked. If over-inked, the drive gears or rollers could slip on the ribbon and the ribbon will not advance. In a short time the substrate will be damaged and the ribbon will be unusable and must be discarded.

If under-inked, the customer will get a poor yield and will have to re-ink the ribbon more often. Under-inking also diminishes the lubricating effect between the ribbon substrate and the printhead resulting in an increase of abrasion and premature wear or damage to the ribbon substrate.

It is difficult to control re-inking accuracy with the prior art because one cannot see how much ink is being applied to the substrate during the re-inking process. If the operator leaves the ribbon on the re-inker too long it may become over-inked. If the operator removes it from the re-inker too soon it may be underinked. The manufacturer of the re-inker does not provide any specific recommendations as to the "quantity of ink" that should be added to the ribbon during the re-inking process, nor is there any way of measuring the amount of ink added to the ribbon.

Re-inking accuracy with the invention is improved. Specific directions instruct the user on when and how much ink to add to the reservoir based on the following means of measurement:

1. Comparison of print density (blackness) to color charts, gauges or sample printouts supplied with the ribbon with specific directions advising the user at what level of print density ink is to be added to the reservoir.

2. Recommendations advising the user that a specific number of pages of printout can be expected between each refilling of the ink reservoir.

3. Instructions as to a specific amount of ink to be added to the reservoir when refilling. This may either be a specific number of drops or an amount to cover a specific area on top of the reservoir.

Following these recommendations will eliminate the conditions of underinking or overinking and minimize the need for special "skills" or "observational abilities" or guesswork when re-inking, as is required when using devices such as the MAC INKER TM automatic ribbon re-inker.

Convenience and Cleanliness

The prior art is generally considered to be a messy process because of the excessive amount of handling of ribbons and ink due to the fact that they are repeatedly removed from the printer, installed in the MAC INKE TM automatic ribbon re-inker type re-inking device and then must be re-installed in the printer. Operators can get a lot of ink on their hands by touching the ribbon itself or accidentally touching the re-inking roller or pad on the re-inking device. Ink also may accidentally leak or spill from the bottle, re-inking roller or re-inking pad.

The invention eliminates these problems because the ribbon is never removed from the printer during re-inking or refilling. Ink is added directly to the ribbon's easy fill reservoir which has adequately sized openings to prevent leakage, spillage and overfill. The ink itself is provided in special drip proof bottles or other similar drip proof containers. Over 75% of all "handling" processes are eliminated and as a result the "inky mess" is controlled and minimized.

Extended Printer Life

An additional benefit of the invention over the prior art is an extended print head life and a reduction of printer failure and maintenance expense. In the prior art, ink depletion occurs and the lubricating effect of the ink between the ribbon substrate and the printhead is diminished. Abrasion on the printhead and printpins is therefore increased and life of the printhead may be shortened.

According to the invention, when applied as directed, the ink is always at an optimal level and hence the lubricating effect is optimal while abrasion is minimized. It can be compared to maintaining optimum levels of oil and lubricants in an automobile.

Cost, Energy, Petroleum and Landfill Benefits Compared to Prior Art

With the present invention ribbon life is extended by 3 to 10 times and possibly more. The cost savings to the user are obvious. Overall savings to the user could be anywhere from 33% to 80%. The user will also save printer maintenance costs and the expense involved in purchasing re-inking machines such as the MAC INKER TM automatic ribbon re-inker.

Many of the materials used in the manufacture of printer ribbons are petroleum derivatives. These materials include the plastic cartridge components, ink and substrate materials. The concept in my re-inkable arrangement can be applied to most all styles and types of cartridge printer ribbons. If it were applied to the majority of cartridges, many barrels of petroleum could be saved. This would be a contribution to energy conservation and self-sufficiency for our nation.

Cartridge printer ribbons are not bio-degradable. After they are used, they must be dumped in a landfill. If burned, they emit highly toxic gases, so incineration is not recommended. The re-inkable arrangement can reduce the amount of used ribbons going into landfills.

The prior art of re-inking using the MAC INKER TM automatic ribbon re-inker device requires a certain amount of experimentation, self training, experience and improvisational skill before a satisfactory result can be achieved with the method. With the new technology which incorporates the re-inkable arrangement in the cartridge the process has been simplified and the directions provided are clear and complete so that the method will work satisfactorily without a lot of time spent on observations, experimentation, self-training and improvisation.

Even with a re-inkable pad arranged below an opening in a cartridge cover, there can be a tendency to add too much ink or to drop the ink near the outside edges of the pad or roller. As a result, the ink can migrate toward and over the edge of the pad or roller, before it can be absorbed. The ink can also flow between the bottom of the cartridge cover and the top of the pad or roller, and over the edge of the pad or roller, even though the cover may be pressed tightly against the pad or roller.

This complication may result in an excess amount of ink flowing directly onto the ink transfer roller, rather than the measured amount which would be applied when the ink is properly absorbed by the roller or pad and then transferred to the transfer roller.

By minimizing contact between the rim of the opening and the pad or roller, the problems are minimized. The opening need not necessarily be larger than the top surface of the pad or roller, although this is desirable.

A solution to this problem has been devised which utilizes a cupped pad or roller. The surface of the pad or roller is recessed in such a way as to contain the ink which is added so that the ink will not flow over the edge of the pad. The cupped ink rollers or pads may be produced in a variety of styles and using a variety of manufacturing techniques. The pads or rollers may be molded or can be fabricated from stock materials.

Another problem which has been experienced is the excessive wear and degradation of the nylon substrate during long term use. This problem is especially evident in small cartridge ribbons such as the OKIDATA and PANASONIC printer ribbon cartridges and even more so with 24 pin dot matrix printers as opposed to 9 pin dot matrix printers.

In order to increase the life of the nylon substrate, its length can be increased. In order to accomplish this, it is advantageous if the cavity which contains the nylon substrate can be enlarged. The invention provides at least two methods of accomplishing this feat. In known cartridges the printer ribbon is fanfolded within a cavity defined by cavity walls. The cartridge is held within the printer by pins which interfit into pin receptors formed as inverted cups in a bottom wall of the cartridge. Typically, the pin receptors intrude within the cartridge and the cavity walls must be designed to distance the ribbon away from the pin receptors. Otherwise, operational problems may occur. The pin receptors cause a reduction in the cavity space thereby limiting the length of the ribbon substrate.

According to the invention, the pin receptors structure can be eliminated and replaced by a small opening in the base of the cartridge. The base of the cartridge is thick enough to allow only a very slight intrusion of the pin into the cartridge and the base may also be made thicker without effecting the operation of the cartridge. Due to the lack of pin receptor structure, the cavity walls can now be moved outward, increasing the size of the cavity and allowing a longer length of ribbon to be used, resulting in increased ribbon life. A very slight intrusion of the pin into the ribbon cavity will not effect operation of the ribbon.

According to another aspect of the invention, the ribbon cavity in a cartridge is increased by using a two-level cartridge. Presently, all cartridges which utilized ink retaining rollers or pads contain the roller or pad on the same level as the ribbon substrate. The two components are separated by a wall in the cartridge.

A cartridge is fashioned whereby the ink pad or roller is located on a top level of the cartridge and the substrate is located on a lower level. Ink is transferred from the pad on the upper level to the ink transfer or application roller by means of a wick portion protruding downwardly from the top level to the lower level. This arrangement can effectively enable a cartridge to have double the effective length of ribbon and double the life of the substrate.

Another aspect of the invention provides an ink liquid reservoir within the cartridge adjacent to and in contact with the ink retaining pad. A further development provides that the ink reservoir and ink retaining pad are separated by a wall having an openably passage, and a bellows is provided connected to a push button whereby by depressing the push button, ink passes through the passage and deposits onto the ink retaining pad. Thus, the need for a separate ink bottle is reduced as the cartridge itself holds a long-term supply of ink.

An additional advantageous arrangement of the invention locates the opening through the cartridge cover above the ink pad offset from the ink pad so that a vertical edge of the ink pad is exposed in the opening. There are several advantages to this method. First, the user can visually observe and access a greater portion of the roller (or pad). It offers the user a two dimensional view rather than a single dimensional view. This further enables the user to avoid problems relating to inadvertently overapplying ink.

Also, by offsetting the opening, since less of the underside of the cover and rim of the opening comes into contact with the roller or pad, should the user inadvertently overapply the ink, rather than weep under the cover, the ink of the pad or roller will flow over the edge and down the side of the pad or roller and eventually be absorbed into the pad or roller. In contrast, when the underside of the cover and rim of the opening come into greater contact with the pad or roller, some ink can weep past the cover and flow directly toward or onto random spots of the substrate if ink is inadvertently overapplied.

Another advantageous aspect of the invention is to fuse the underside of the cover to the top of the roller or pad in various configurations to prevent ink from weeping into the area of the substrate and the ink transfer roller. This may be accomplished ultrasonically, by heat, or chemically as with certain specialized adhesives such as those used for plastics. Also, the inker case walls can be fused, where any gaps may appear, to the base or top of the cartridge.

Each time ink is applied to the pad or roller, a small amount of ink may remain on the tip or spout of the ink bottle. When the bottle is returned to its upright position, the ink then runs or flows down the outside wall of the spout. After repeated use, the ink accumulates on the bottle and it can become quite messy. The proposed methods of larger openings and/or cupped rollers provides a means by which this problem can be minimized. For example, the user may touch, scrape, or dab the tip of the spout to an area of the pad or roller to which he has not added any ink. In the case of the openings which exceed 100% of the pad or roller, the spout can be scraped or rubbed to the side of the ink pad or roller, even if the top of the pad or roller is completely covered with ink. In the case of cupped rollers, the tip can be scraped on the edge of the indented or cupped area to remove excess ink.

Some ink cartridges are attached to or loaded onto their corresponding printer at an angle of inclination to the horizontal. In these cases, the ink pad below the aperture for adding ink droplets is advantageously configured to have a horizontal surface for receiving the ink droplets and dispersing the ink throughout the pad. Additionally, the pad otherwise at an inclination with the cartridge can be provided with a true vertical bore for receiving ink through the aperture and the top cover for dispersal throughout the pad or roller.

For increasing dispersal of ink throughout a pad or roller, a plurality of spaced apart bores can be provided in the pad or roller, penetrating into, but not entirely through, the pad or roller. In an exemplary embodiment, a trough can be applied around a circumference within the pad or roller which connects a plurality of bores so that filling of the pad or roller can be accomplished at one location with the ink dispersing through the trough and into the individual bores.

In a further development of the invention, additional openings or apertures can be provided around an outside surface of the ink pad or roller to give flexibility to the dispensing of ink onto the roller. By allowing the user to apply ink to multiple surfaces of the pad or roller, more complete dispersion and less "hot spotting" results.

The present invention describes in the figures advantageous ink retaining masses such as ink pads or ink rollers for transferring ink held therein onto ribbons. It is within the scope of the invention to provide such ink retaining masses, such as an ink pad with a dished out surface or any of the other ink pads disclosed herein to printing systems wherein a ribbon is not used, that is, wherein ink is transferred from the ink retaining mass onto the paper by other means.

BRIEF DESCRIPTION OF THE DRAWINGS

FIG. 1 is a perspective view of a printer ribbon cartridge showing an application of the invention;

FIG. 2 is a sectional view taken generally along line II—II of FIG. 1;

FIG. 3 is a partial sectional view taken generally along line III—III of FIG. 2;

FIG. 4 is a plan view of an alternate cover as can be applied to the cartridge of FIG. 1;

FIG. 5 is a plan view of another alternate cover to the cartridge of FIG. 1;

FIG. 6 is a graphical printing guide or key for testing printing output;

FIG. 7 is an alternate embodiment of a printer cartridge;

FIG. 17B is a partial plan view of an alternate embodiment of the present invention;

FIG. 21 is a partial sectional view of an alternate embodiment of the present invention;

FIG. 22 is a sectional view of an alternate ink pad of the present invention;

FIG. 22A is a sectional view of an alternate ink pad of the present invention;

FIG. 23 is a sectional view of an alternate ink pad of the present invention;

FIG. 24 is a sectional view of an alternate ink pad of the present invention;

FIG. 25 is a sectional view of an alternate ink pad of the present invention;

FIG. 26 is a sectional view of an alternate ink pad of the present invention;

FIG. 26A is a sectional view of an alternate ink pad of the present invention;

FIG. 27 is a top plan view of the embodiment shown in FIG. 26;

FIG. 28 is a top plan view of an alternate embodiment of the present invention;

FIG. 29 is a plan view of a prior art cartridge with the top cover removed for clarity;

FIG. 30 is a sectional view taken generally along line 30—30 of FIG. 29;

FIG. 31 is a plan view of an alternate cartridge with the top cover removed for clarity;

FIG. 32 is a sectional view taken generally along 32—32 of FIG. 31;

FIG. 32A is an alternate embodiment of the sectional view of FIG. 32;

FIG. 33 is a plan view of an alternate printer cartridge with portions removed for clarity;

FIG. 34 is a sectional view taken generally through line 34—34 of FIG. 33;

FIG. 35 is a sectional view taken generally along line 35—35 of FIG. 33;

FIG. 36 is a top plan view of the cartridge of FIG. 33;

FIG. 37 is a top plan view of an alternate cartridge with the top cover removed for clarity;

FIG. 38 is a sectional view taken generally along line 38—38 of FIG. 37;

DETAILED DESCRIPTION OF THE PREFERRED EMBODIMENTS

Figure 8:
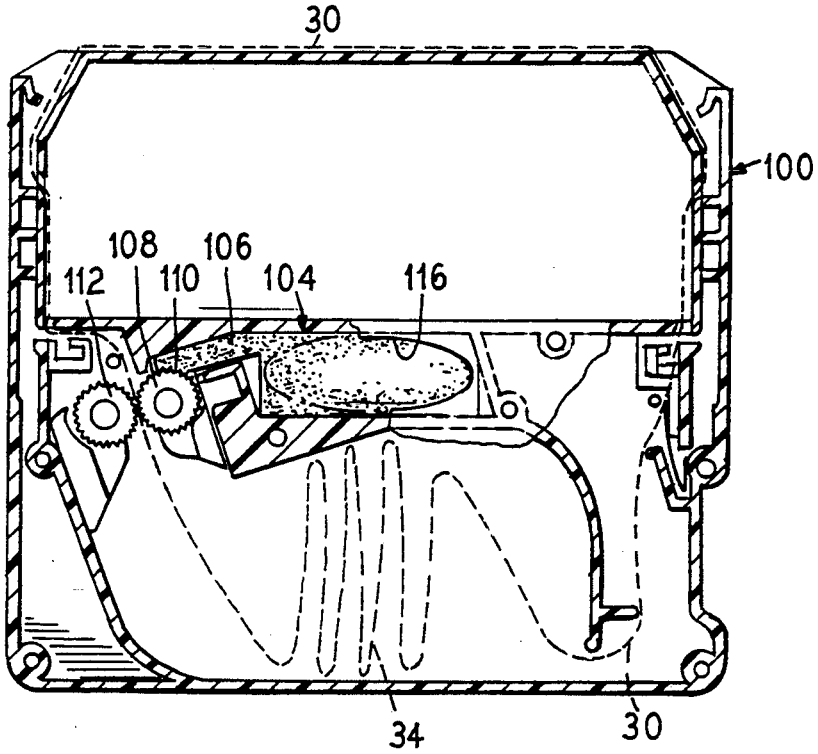
FIG. 8 is a second alternate embodiment of a printer cartridge.

FIG. 1 shows generally at 10 a printer cartridge. Many configurations of printer cartridges for computer printers, typewriters, word processors, and the like are currently available, only a few of such cartridges are illustrated herein. The cartridge 10 of FIG. 1 corresponds generally to an Okidata Microline 182 fabric cartridge with re-inker but modified by the present invention. The cartridge 10 is engaged to a printer 14 as is known in the art. The cartridge 10 provides a head portion 16 for interaction with the printing mechanism and the paper. However, according to the present invention, the cartridge 10 provides a top cover 22 and sidewalls 24 as well as a bottom plate 25 (shown in FIG. 3). An annular lip 26 is mounted onto the cover 22 and circumscribes an opening 27. This opening 27 is an important attribute of the present invention and will be described hereinafter.

FIG. 2 shows a ribbon 30 extending throughout the cartridge 10 in a continuous loop. Excess ribbon 30 is fan folded into a space 34 inside the cartridge 10. In the preferred embodiment the ribbon 30, commonly a woven nylon cloth ribbon as known in the industry, would be 3 mil, 4 mil, or 5 mil in thickness with a thread count of 280 or more, or a high density nylon with a thickness of 5–5.2 mil on a thread count of 300 or more. The ribbon 30 is pinched between a drive roller 46 and a idler roller 42. The idler roller 42 presses against an ink pad such as an ink roller 28 rotatably mounted on a spindle 38. The ink roller 28 is located directly beneath the opening 27. The ink roller 28 is made of an absorbent type material such as a foam or felt material having pores which can absorb and hold ink therein. The idler roller 42 constantly removes some ink from the ink roller 28 and deposits the ink onto the ribbon 30 as it passes between the drive roller 46 and the idler roller 42.

FIG. 3 shows an inventive method of re-inking the ink roller 28. A spill resistent, drip resistent ink bottle 49 is used to manually drop a measured amount of ink 49*a* onto a top 28*a* of the ink roller 28. The ink bottle 49 can be a drip-proof squeeze bottle or a dropper bottle which utilizes an "eye dropper" type delivery device having a squeeze bulb at one end of an open ended tube. A plunger-syringe type device can also be used. Periodic replenishing of the ink by this manual means can prolong the useful life of a cartridge dramatically. The lip 26 prevents overfilling and spillage out of the opening 27 and the lip overlies the ink roller 28 to prevent extraction of the roller 28 out of the opening 27.

FIG. 4 shows a cover 50 which can be mounted on top of the opening 27 to act as a guard against touching the ink roller 28 and smudging fingers and effectively retains the ink roller in position especially when handling the cartridge. The cover 50 provides a plurality of apertures 54 for dropping the ink therethrough onto the ink roller 28 in a dispersed manner to quickly and evenly add ink throughout the ink roller 28.

FIG. 5 shows an alternate cover 60 to the cover 50 as shown in FIG. 4. This alternate cover 60 provides two slats 60*a*, 60*b* which divide the cover 60 into three openings 64*a*, 64*b*, 64*c* for dispensing the ink therethrough. The slats 60*a*, 60*b* prevent fingers from touching the ink roller 28.

FIG. 6 shows a printing guide or key 69 which provides to a user a simple easily comprehended guide to determining the ink quantity status of the cartridge 10. If the printer output resembles the dark print at 70 the ink level in the cartridge 10 is adequate. However, if the print output resembles the fainter print at 72 then the instruction is communicated to add a measured amount of ink to the ink roller 28. The instruction for adding ink is in fact incorporated into the fainter print at 72.

FIG. 7 shows an alternate embodiment 78 of the cartridge 10 which generally corresponds to a commercial cartridge, Drucker, Riteman f+/c+ but modified by the present invention. Two counter wheels 84, 86 are provided which remove ink from the ink roller 28 and deposits the ink onto the ribbon 30. The cartridge 78 is split into two casings, a first casing 90*a* and a second casing 90*b*. The second casing 90*b* holds the ink roller 28. According to the present invention, an opening 92 arranged in a cover 90*c* of the second casing 90*b* is aligned above the ink roller 28. A cage 80 is provided covering the opening 92 to prevent finger smudging by contact with the ink roller 28. The ink 49*a* can be dropped through the cage 80 onto the ink roller 28.

FIG. 8 is a second alternate embodiment 100 of the cartridge 10. This embodiment is generally that of Injection Point Technology, Inc.'s version of the NCR 2140 cartridge but modified by the present invention. An idler gear 108 makes contact with an ink retaining mass 104 at a contact point 110. The ink retaining mass 104 is an absorbent material which holds ink therein. The ink retaining mass 104 is generally rectangularly shaped with a protruding branch 106. The ink is transferred from the ink retaining mass 104 along the branch 106 by capillary action to make contact at the contact point 110 with the idler gear 108. The idler gear 108 transfers ink onto the ribbon 30, which is pinched between a drive gear 112 and the idler gear 108. This ink retaining mass 104, according to the Applicant's present invention, can be communicated with through an oblong opening 116 through a top cover of the cartridge 100.

Figure 9:
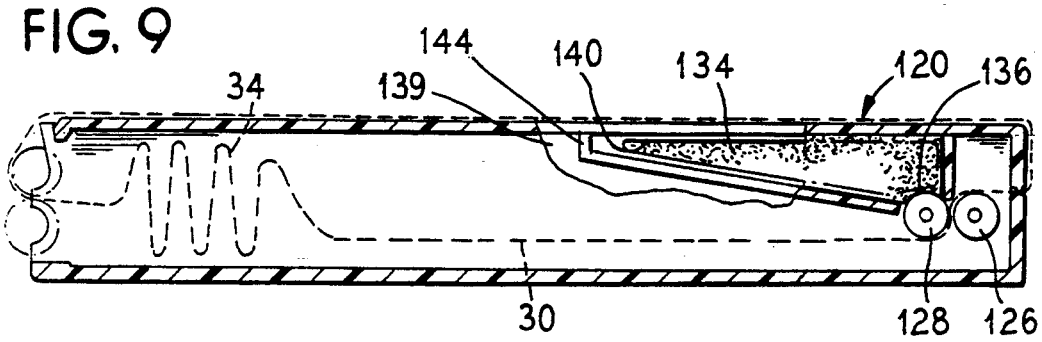
FIG. 9 is a third alternate embodiment of a printer cartridge.

FIG. 9 shows a third alternate embodiment cartridge 120 wherein the cartridge corresponds to a modified IBM System 32 Model B Harmonica Fabric cartridge. Applicant has added an ink applying roller 128 communicating closely with a second roller 126 which pinch the ribbon 30 therebetween. The ink applying roller 128 makes contact at a contact point 136 with an ink reservoir 134 which is an ink absorbent material. The ink applying roller 128 therefore would remove ink from the reservoir 134 and place the ink onto the ribbon 30. Through a cover 139, shown partially in FIG. 9, an opening 140 is provided aligned above the reservoir 134, for adding ink thereon. A lip 144 can be utilized around the opening 140 to facilitate adding a cover and to prevent finger smudging. The reservoir 134 can be shaped triangularly as shown in the figure.

Figure 10:
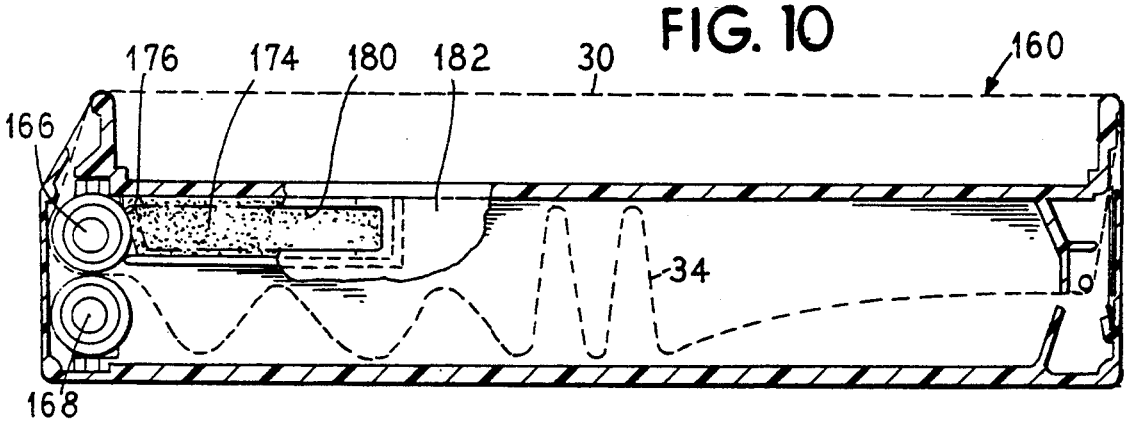
FIG. 10 is a fourth alternate embodiment of a printer cartridge.

FIG. 10 shows a fourth alternate embodiment 160 of the cartridge which corresponds to a cartridge such as a modified Shinwa SP 80 or a modified IBM 4214. According to the invention, applicant adds an ink reservoir 174 which makes contact at a contact point 176 with an inking roller 166 which pinches the ribbon 30 against a drive roller 168. The inking roller 166 removes ink from the reservoir 174 and places the ink onto the ribbon 30. The reservoir 174 is rectangularly shaped and can comprise a sponge-like ink absorbent material. A portion of a top cover 182 is shown with a rectangular opening 180 aligned above the reservoir 174 for dropping ink therethrough to replenish the reservoir 174.

Figure 11:
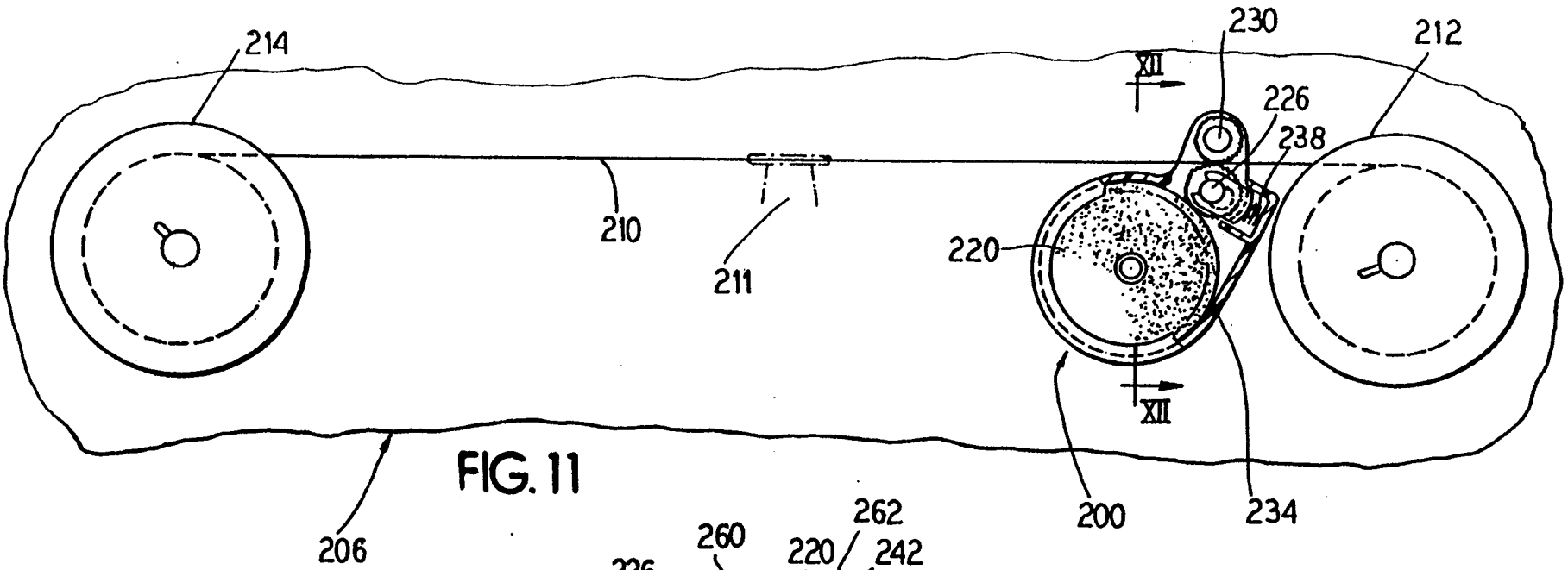
FIG. 11 is a partial plan view of a printer and a reinking arrangement, in fragmentary view, for use with a spooled ribbon.

As clear from the aforementioned apparatus description the invention provides an efficient means to re-ink a cartridge. As shown in FIG. 11 a re-inking apparatus 200 can be applied to a printer 206 having a spooled ribbon rather than a cartridge. As shown in FIG. 11, the printer 206 has a spooled ribbon 210 in printing communication with a printer head 211. The spooled ribbon 210 is wound around and carried by two spools, a first spool 212 and a second spool 214. The ribbon progresses in use from one of the spools 212, 214 to the respective other spool 212, 214 as is known. The re-inking apparatus 220 provides an ink retaining mass 220 for holding a supply of ink therein, such as described above with respect to the cartridge ink retaining masses or ink retaining reservoirs. The ink retaining mass 200 comprises an absorbent material for holding the ink therein. The re-inking apparatus 200 also provides a drive roller 226 in rolling abutment with the retaining mass 220 and an idle roller 230. The ribbon 210 is pinched between the drive roller 226 and the idle roller 230. The drive roller 226 removes ink from the retaining mass 220 and deposits the ink onto the ribbon 210 as the ribbon 210 progresses past the drive roller 226, and the drive roller 226 rolls against the retaining mass 220. Surrounding the re-inking apparatus 200 is a frame 234 which rotatably mounts the retaining mass 220, rotatably mounts the drive roller 226, and rotatably mounts the idle roller 230. The drive roller 226 is spring biased off the frame 234 with a spring 238 so that the drive roller 226 resiliently presses against the retaining mass 220 and presses the ribbon 210 against the idle roller 230.

Figure 12:
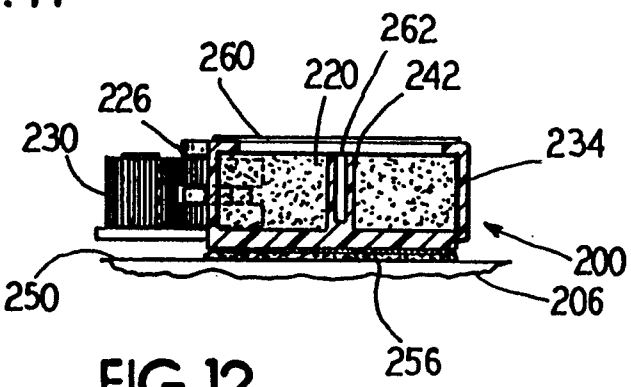
FIG. 12 is a section view taken generally along line XII—XII of FIG. 11.

FIG. 12 shows in section the re-inking apparatus 200 with the retaining mass 220 as a cylindrically shaped roller rotatably mounted to a spindle 242. The re-inking apparatus 200 is shown mounted to a top surface 250 of the printer 206 by the convenient use of an adhesive arrangement 256. The adhesive arrangement 256 can comprise glue, self-sticking tape or two-sided tape, mechanical surface fasteners such as VELCRO brand strips with adhesive on outer surfaces to bond to the re-inking apparatus 200 and the top surface 250 respectively, or any other known means to fasten the re-inking apparatus 200 to the printer 206. Clamps, screws, or mechanical fasteners are also encompassed by the invention. Also shown in FIG. 12 is a cover 260 which can completely cover an exposed surface 262 of the retaining mass 220 to prevent contact from a user's finger, and which can be removed to resupply the retaining mass 220 with ink according to the invention. It should be noted that this removable cover 260 can also be incorporated in all of the embodiments of the ink pad or roller of the present invention including all of the cartridge applications. Additionally, the various apertured covers described hereinabove for the cartridges can be used with the embodiment of FIG. 12 for dropping ink therethrough.

With regard to the Okidata type cartridge 10 of FIG. 1, the following method will provide consistent, intense printout throughout the life of the ribbon 30. Generally, the user should add ink to the ink roller 28 every 200–300 pages of average printout. Enough ink should be added to cover the top surface 28*a* of the ink roller 28, which would be approximately 10–12 drops of ink.

The invention in any of the above described embodiments, provides an improved method of maintaining a proper amount of ink in a printer ribbon. The primary causes of variations in re-inking frequency, in the present invention "re-inking" being the addition of ink to the ink pad, are:

(a) amount of printout per page, (b) type of paper being used, (c) impact setting on printer.

The refilling method of the present invention, however, is very flexible and almost foolproof as long as the user applies common sense.

A rule of thumb for the method is, when the printout begins to noticeably become lighter, the user is instructed to add about 10 drops of ink, to cover the surface 28*a* of the ink roller 28. The user is instructed to not wait until his printout becomes very light. At that point, two or three applications of ink may be required to bring the ribbon 30 back to maximum printing darkness or intensity.

As part of the invention the guide 69 provides a foolproof method to maintain the ink roller 28 at sufficient capacity with ink. If current in-use printer output resembles the printing at 70, no ink should be added. If, however, the printer output resembles the printing at 72 or lighter, the user is instructed to add 10–12 drops of ink. The printer output should return to the intensity as displayed in the printing at 70 within the next 20–30 pages of printout or sooner. If after that time the printing intensity does not return to the intensity of the printing at 70 the user is instructed to add another 5–6 drops of ink to the printing roller 28.

If the user has used the printer to a point where the printing is significantly lighter than that shown at printing 72 it may take 2 or more applications of ink before the ribbon 30 returns to the intensity of the printing at 70. The method of applying the ink is as follows:

1. Add 10–12 drops of ink to the ink roller 28.
2. Run a printout.
3. Add between 5–6 drops of ink to the ink roller repeatedly, running a printout between each application, until the user sees that the printout has returned to the intensity of the printing at 70.

The user is cautioned against overapplying ink to the ink roller 28 and cautioned that it takes some time for the ink to be absorbed by the ink roller 28.

Figure 13:
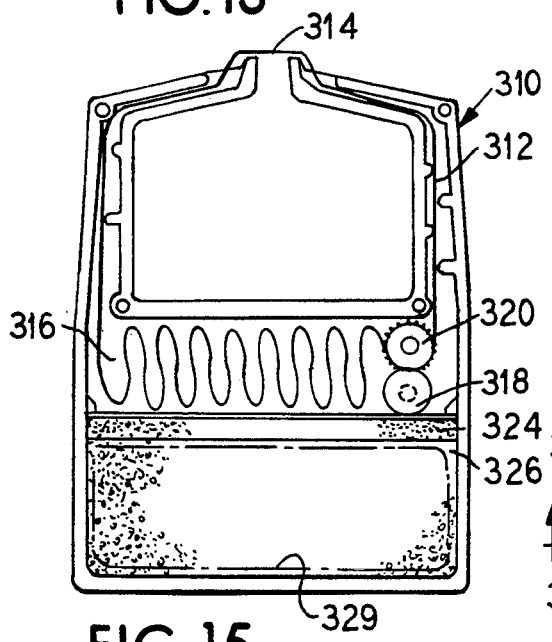
FIG. 13 is a plan view of a cartridge with a top cover removed for clarity incorporating the present invention.

FIG. 13 shows a printer cartridge 310 having a looped ribbon 312 extending to an exposed position 314 for access to the printer head (not shown) in a printer. The ribbon 312 is fanfolded in a central region 316. The ribbon passes between an ink transfer roller 318 and a pinch roller 320. On an opposite side of the ink transfer roller 318 is arranged a wick 324 which presses against the ink transfer roller 318. An ink pad 326 is provided on an opposite side of the wick and pressed thereto. An opening is provided above the ink pad through which ink can be resupplied to the ink pad. The ink pad thus stores a supply of ink and transfers that ink through the wick to the ink transfer roller 318 for resupplying ink to the ribbon 312. An opening 329 through a top cover of the cartridge 310 above the ink pad 326 for adding ink to the pad is shown in phantom.

Figure 14:
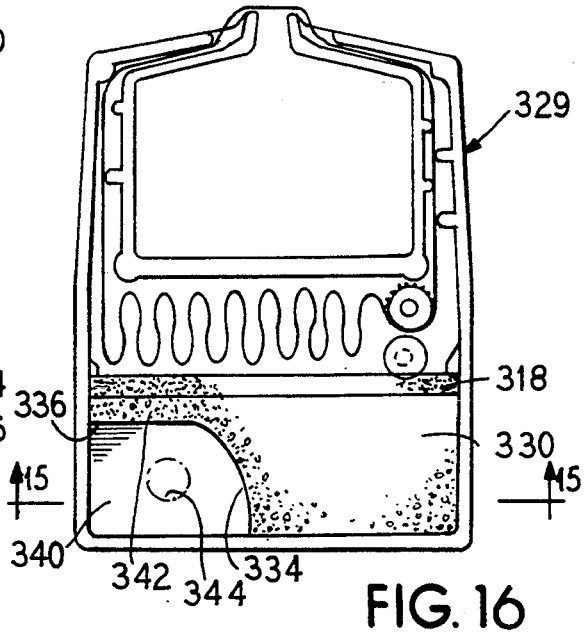
FIG. 14 is an alternate embodiment to the cartridge of FIG. 13.

FIG. 14 shows an alternate embodiment where an alternate ink pad 330 is fashioned having a concave limit 334 which defines, along with inside walls 336 of the cartridge 329, a volume 340 for holding a liquid supply of ink. This volume 340 is accessible through a hole 344 in a top cover 349 of the cartridge shown in phantom, for adding ink. An elongate region 342 of the ink pad 330 which is adjacent the wick 318 can alternately be eliminated so that the liquid ink in the volume 340 contacts both the wick and the ink pad. In this embodiment, the volume 340 would be defined by the walls 336, the wick 318 and the ink pad limit 334.

Figure 15:
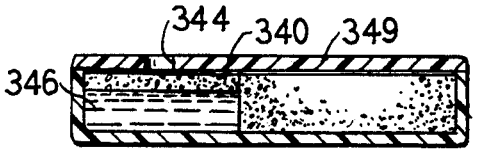
FIG. 15 is a sectional view taken generally along line 15—15 of FIG. 14.

FIG. 15 shows a supply of ink 346 held in the volume 340. The ink maintains the ink pad 330 in a saturated condition and extends the working life of the cartridge for resupplying with ink.

Figure 16:
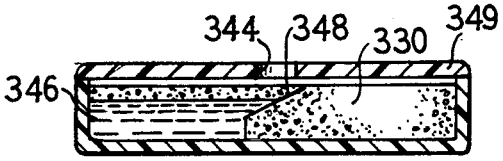
FIG. 16 is a sectional view of an alternate embodiment of the arrangement shown in FIG. 15.

FIG. 16 shows a further embodiment of the arrangement of FIG. 15 where the ink pad 330 provides a sloping surface 348 adjacent the ink 346. This sloping surface 348 allows close level control when adding ink as an increase in height of the ink level per drop added is reduced by the increased ink volume due to the sloping surface 348. The surface 348 also increases the surface area of the pad 330 in contact with the ink 346.

Figure 17:
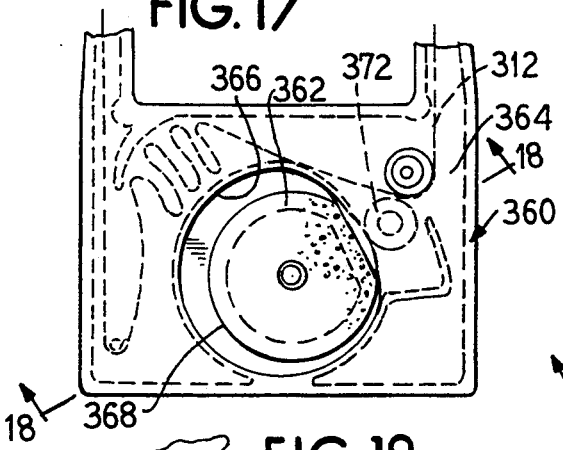
FIG. 17 is a partial plan view of an alternate embodiment of the invention with the cover removed for clarity.
Figure 18:
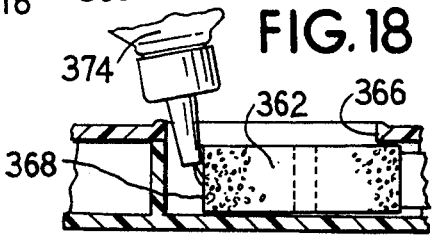
FIG. 18 is a sectional view taken generally along line 18—18 of FIG. 17.

FIG. 17 shows an alternate embodiment of a cartridge 360 having a rotatable ink pad or ink roller 362 shown beneath a top cover 364 of the cartridge. An opening 366 is provided partially over the roller 362 so that an edge 368 of the roller 362 is visible through the opening 366. The roller 362 is pressed against an ink transfer roller 372 and the transfer roller 372 passes ink onto the ribbon 312. As shown in FIG. 18, by placing the edge 368 within the opening 366, there allows the opportunity to dab or touch a tip of an ink bottle 374 to the edge 368 to maintain a clean ink bottle 374. Additionally, by being able to view a side edge 368 of the pad 362, overfilling and oversaturation of the ink pad can be prevented.

Figure 17A:
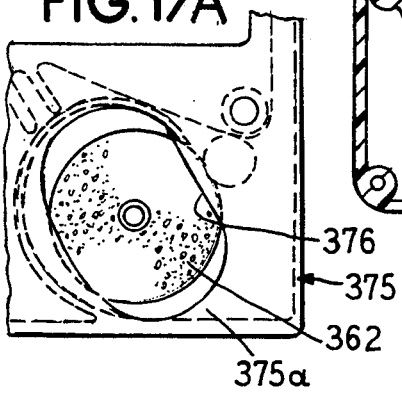
FIG. 17A is a partial plan view of an alternate embodiment of the invention.

FIG. 17A illustrates a cartridge 375 having an opening 376 through a cover 375*a* over the pad or roller 362 having a nonsymmetrical shape. This cover 375*a* overlies part of the roller 362 to prevent extraction of the roller through the opening 376, but exposes an edge 368 for effective observation and dabbing of the tip of the ink bottle.

FIG. 17B illustrates a cartridge 377 which provides an opening 378 which, similar to FIG. 17, exposes an edge 368 of the roller 362, but also exposes the transfer roller 372 which allows observation of the roller 362/transfer roller 372 interface to observe proper operation and which also provides the advantages enumerated for FIG. 17.

Figure 19:
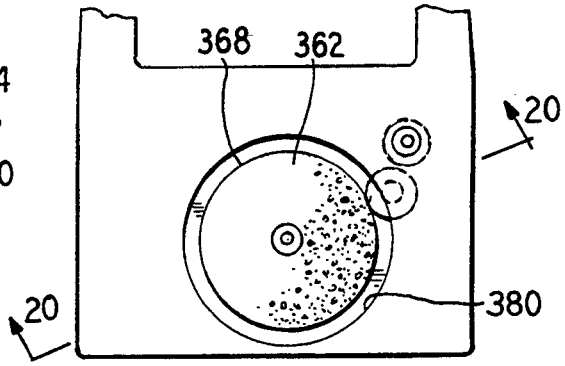
FIG. 19 is a partial plan view of an alternate embodiment of the invention with the top cover removed for clarity.
Figure 20:
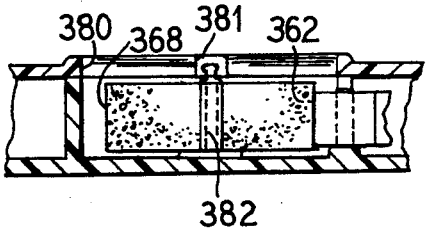
FIG. 20 is a sectional view taken generally along line 20—20 of FIG. 19.

FIG. 19 shows an alternate view wherein the ink roller is not mounted eccentrically with respect to the opening, but rather the opening 380 is concentric with the roller 362 and the opening 380 is larger than the roller 362 so that substantially all of the edge 368 can be seen around the roller. As shown in FIG. 20, a cap 381 over the pin 382 holds the roller 362 and prevents the roller from falling out through the hole 380 if the cartridge is inverted.

FIG. 21 shows a further embodiment wherein an ink pad 400 is arranged beneath a top cover 402 of a cartridge. The top cover 402 provides an opening 404 for dropping ink 406 onto the ink pad 400. To eliminate the problem of ink weeping between the ink pad 400 and the cover 402, which can result in excessive ink "hot spotting" on the ribbon, a top annular surface 410 of the pad 400 is fused to a bottom annular surface 412 of the cover 402. Ink dropped through the opening 404 thus must pass into the pad 400. The pad 400 can be elevated by a gap 413 from a bottom wall 414 to prevent ink progression along the bottom wall 414.

Additional provisions for reducing or eliminating weeping past the ink pad are shown in FIGS. 22–28.

In FIG. 22, an ink pad such as an ink roller 420 provides a cylinder 422 for holding the roller pin and a dished-out area 424 which is arranged to lie beneath an opening in the cover (not shown). Ink dropped onto the pad within the dished-out area 424 will be constricted to remain therein and permeate through the pad 420. FIG. 22A shows an ink pad or roller 420*a* with an increased dished out area 424*a*. The dished out area can range from less than 1% to 80% of the ink pad volume.

In FIG. 23, a broad dished-out area 428 in a pad 430 is used. Additionally, an opposite dished out area 428*a* and a circumferential area 428*b* can be provided to allow the pad 430 to be used in a variety of orientations in a printer, providing effective dishout areas to retain ink.

In FIG. 24, a pad 432 uses a straight declined surface 434 around the roller.

FIG. 25 shows an annular semicircular dished-out portion 438 arranged on a top surface of a pad 440. In this configuration, the ink is also retained away from the channel 422 to prevent ink from seeping between the roller and the channel.

The dished-out upper surfaces as shown in FIGS. 22–25 can be used for either an ink roller or an ink pad of circular, elongate, or other shape.

FIG. 26 shows an alternate embodiment wherein a pad 450 provides a plurality of indentations 454 such as circular indentations for holding ink on a top surface of a pad to prevent weeping around the pad.

FIG. 26A illustrates an alternate embodiment to FIG. 26 wherein rather than the indentations 454, through holes 454*a* are provided in a pad or roller 450*a*, which, in conjunction with the floor 414 of the cartridge, retain ink to be absorbed by the pad or roller 450*a*.

FIGS. 27 and 28 show alternate views of the indentation arrangement, either indentations 454 or smaller indentations 455 can be provided. Respectfully sized through holes 454*a* could also be thusly arranged.

Another problem which has been experienced in providing a reusable and reinkable cartridge is excessive wear and degradation of the nylon substrate of the ribbon during long term use. This problem is especially evident in small cartridge ribbons such as the OKIDATA and PANASONIC printer ribbon cartridges and even more so with 24 pin dot matrix printers as opposed to 9 pin dot matrix printers.

In order to increase the life of the nylon substrate, the length of the substrate can be increased. However, in order to accomplish this, the cavity which contains the nylon substrate should be enlarged.

FIG. 29 shows a cartridge 470 for a PANASONIC printer. Within this cartridge are cavity walls 472, 474 which enclose a cavity 476 for fan folding the ribbon 480 therein. The cartridge shows pin receptors 486, 488 in the vicinity of the cavity walls 472, 474. As shown in FIG. 30, the pin receptor 486 comprises an inverted cup configuration for receiving a pin 492 projecting upward from a base 494 of a printer (not shown) which holds the cartridge.

The pin receptors 486, 488 intrude within the cartridge and the cavity walls 472, 474 must be designed to keep the ribbon 480 away from the pin receptors 486, 488. Otherwise, operational problems may occur. As a result of this intrusion, a reduction in the cavity space causes a limit to the length of the ribbon substrate fanfolded therein.

FIGS. 31, 32 and 32A show a modified pin receptor 500 which comprises a hole rather than the inverted cup such as the pin receptor 486. By eliminating the upwardly extending structure, the pin receptor 500 can occupy a space within the cavity for fan folding the ribbon, without interference with operation. Therefor, the cavity walls can be spread apart to increase the volume within the cavity.

As shown in FIGS. 32 and 32A, the pin receptor 500 can receive a short pin 504 or a slightly larger pin 504*a* without significantly interfering with the cavity 476.

FIG. 31 shows the advantage of the invention wherein two pin receptors 500, 504 are located within the cavity 506 defined between cavity walls 508, 510. As shown in this Figure, an increased length of fanfolded ribbon can be held therein as compared to FIG. 29.

Presently, nearly all cartridges which utilize reinking rollers or pads contain the roller and pad on the same level as the ribbon substrate. The folded ribbon and roller or pad are separated by a wall in the cartridge. FIG. 33 demonstrates an inventive means of storing an increased length of ribbon within a cartridge. In the cartridge 530, a first cavity 536 is provided for holding fanfolded ribbon and a second cavity 538 is provided above the first cavity 536 for holding an ink pad 560.

FIGS. 33 and 34 illustrates the fanfolded ribbon 542 in the first cavity 536 passing between an ink transfer roller 548 and a pinch roller 550. The ink transfer roller is abutting a wick 554. As shown in FIG. 35, the wick 554 extends across a height of a cartridge and is pressed to the ink pad 560 located in the second compartment 538. Thus, ink deposited onto the ink pad 560 migrates to the wick 554 and down to the ink transfer roller for being applied to the ribbon within the first cavity 536.

As illustrated in FIG. 36, the ink pad is exposed through a square opening 566 for dropping ink thereon.

FIGS. 37 and 38 illustrate another aspect of the invention wherein a cartridge 580 comprises a top wall 584, a bottom wall 586, an inside wall 588 connecting said top wall 584 to said bottom wall 586, and side plates 590, 592 (shown in FIG. 37). A baffle 596 is provided at an opposite end to the inside wall 588. On an opposite side of the baffle 596 is arranged a weir 598. The baffle provides a flow channel 600 adjacent the bottom wall 586. The weir 598 defines a weir flow channel 602 adjacent the top wall 584. A bellows cylinder 606 is provided attached to the top wall 584 and protruding downwardly into a cavity 610 defined between the weir 598, the side plates 590, 592, the inner wall 588, the bottom wall 586 and the top wall 584. Inside the bellows cylinder 606 is a bellows 612 having a push button 614 arranged on a top thereof. The bellows 612 is trapped within the bellows cylinder by the top wall 584 and a bottom annular ledge 618. A finger hole 700 is provided through the top wall 584 aligned with the push button 614.

A slide valve 706 having a valve element 708 and a push lever 710 is arranged to selectively slide to close the flow channel 602. In operation, when the cavity 610 has a supply of ink therein, force downward on the push button 614 compresses the bellows 612 and displaces ink which will then flow under the baffle through the flow channel 600 and over the weir 598 through the flow channel 602 and, assuming that the valve 706 is an open position onto an ink pad 714 for absorption into the ink pad. The ink pad 714 is typically engaged to an ink transfer roller which displaces ink and applies the ink to a ribbon (not shown).

Thus, a supply of ink is included in the cartridge and the ink pad 714 can be replenished merely by pressing the push button 614, rather than using a separate ink bottle. Additionally, no opening need be provided over the ink pad for dropping the ink onto the pad.

Figure 39:
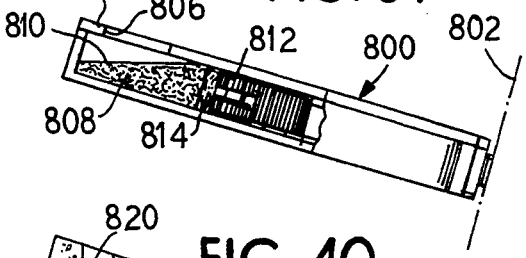
FIG. 39 is a side elevational view of an alternate cartridge with a portion of a side wall removed for clarity.

FIG. 39 illustrates an alternate ink cartridge 800 for use with an inclined mounting within or to a printer illustrated as 802. In this case, the cartridge 800 comprises a top cover 804 having a hole 806 formed therethrough for depositing ink droplets onto an ink pad 808. The ink pad 808 comprises an inclined top surface 810 which generally corresponds to a horizontal orientation when the cartridge 800 is installed to the printer 802. The pad 808 can directly abut an ink transfer roller 812 or a wick member 814 can be applied therebetween.

Figure 40:
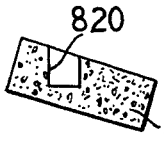
FIG. 40 is a sectional view of an alternate ink pad for use in a cartridge oriented as per FIG. 39.

FIG. 40 illustrates an alternate ink pad 818 for use with a cartridge such as shown in FIG. 39, mounted at an inclination to the printer 802. In this embodiment, a bore 820 is formed, having a generally vertical axis when the ink pad 818 is installed into the inclined cartridge 800. The bore 820 would be beneath the hole 806 so that ink can be dropped directly into the bore for dispersion throughout the pad 818.

Figure 41:
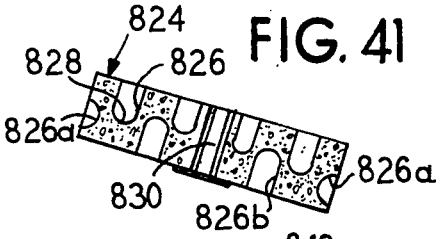
FIG. 41 is a sectional view of an alternate ink roller.

FIG. 41 illustrates an ink roller 824 for use with an inclined cartridge such as the cartridge 800 shown in FIG. 39. In this embodiment, a plurality of bores 826 having rounded bottoms 828 are formed in the roller 824 around a circumference coaxial with the mounting shaft 830 of the roller 824. A single bore could also be provided as well as any desired pattern of bores throughout the ink roller. Side bores **826*a* and bottom bores 826*b* can be provided for flexibility of application of the roller 824** (or pad) to varying orientations.

Figure 42:
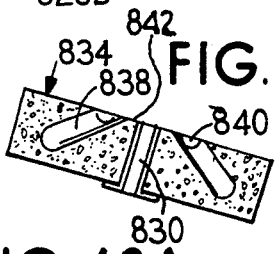
FIG. 42 is a sectional view of an alternate ink roller.

FIG. 42 illustrates a further embodiment of the ink roller of FIG. 41, namely, ink roller 834. The ink roller 834 comprises a plurality of inclined bores 838 having openings 840 nearto the roller shaft 830 and declined radially outwardly therefrom. The ports 840 can be connected by an annular trough 842 for ease of filling with ink.

Figure 43:
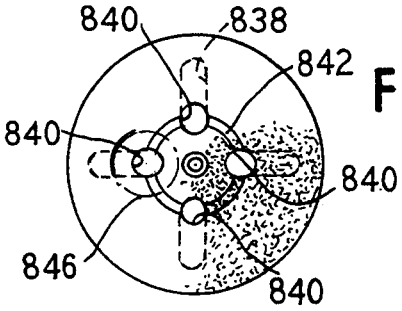
FIG. 43 is a top plan view of the ink roller of FIG. 42.

FIG. 43 illustrates the trough 842 connecting the ports 840. In FIG. 43, a circle 846 indicates the overhead positioning of an ink filling hole through a top wall of a cartridge (not shown). It is noted that the filling hole 846 can be sized to uncover a small portion of a port 840 and/or trough 842 for ink reception, the ink proceeding around the trough 842 to fill the bores 838 through the ports 840, wherein the ink disperses throughout the pad from these bores 838.

Figure 43A:
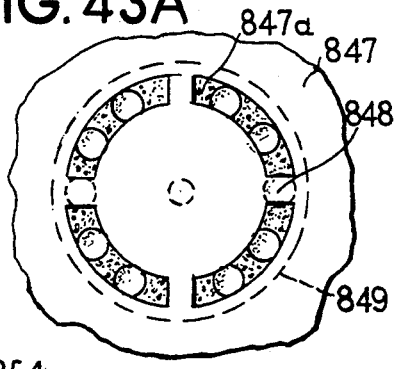
FIG. 43A is a top plan view of an alternate embodiment of the ink pad of FIG. 43.

FIG. 43A illustrates another configuration wherein a top wall 847 of a cartridge is provided with slots **847*a* proceeding in a broken circular pattern above a series of bores 848 arranged on a roller or pad 849**.

Figure 44:
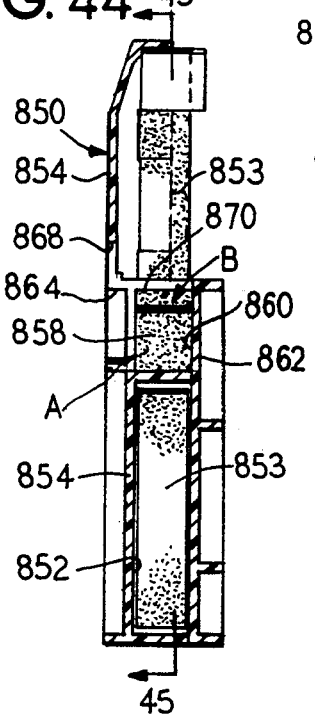
FIG. 44 is a sectional view of an alternate ink cartridge of the present invention.
Figure 45:
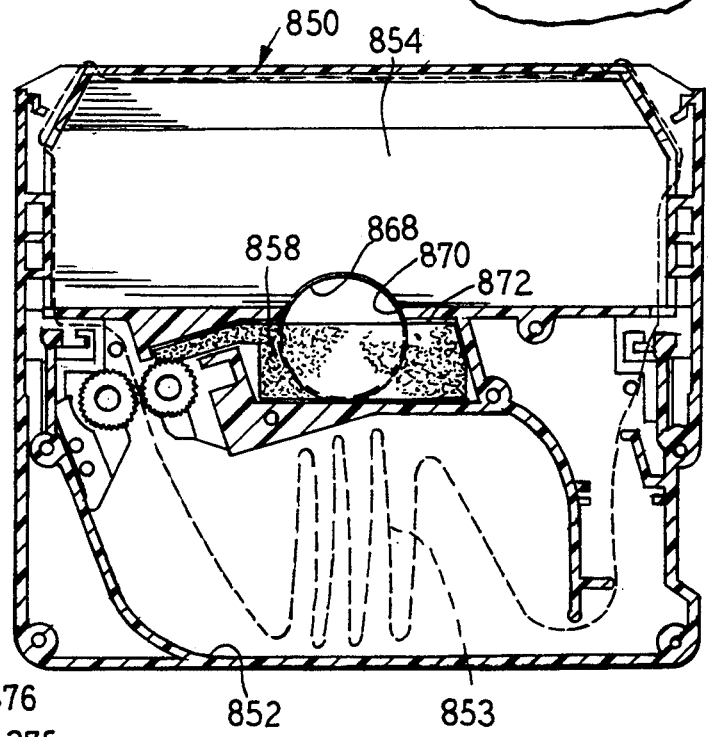
FIG. 45 is a sectional view taken generally along 45—45 of FIG. 44.

FIGS. 44 and 45 illustrate an alternate cartridge 850 having a ribbon cavity 852 for holding fan-folded ribbon 853 therein. A top wall 854 covers a top side of the cartridge 850 protecting the ribbon 853 which proceeds out of the ribbon compartment 852 forwardly to the printer head. An ink pad 858 is provided as described above. The ink pad is partially enclosed in a compartment 860, formed in part by a back wall 862 of the cartridge. The top wall 854 has an offset bend 864. In this embodiment, an aperture 868 is formed through the top wall 854 at a location including the offset bend 864 for dropping ink through the aperture 868 onto the pad 858. Additionally, a portion of a side wall 870 is removed to allow the ink pad to be filled from the direction A through the top wall or the direction B through the side wall 872, whichever open area is most accessible and convenient in a specific printer or some ink added through both the walls to insure diffusion of the ink throughout the entire pad 858.

Figure 46:
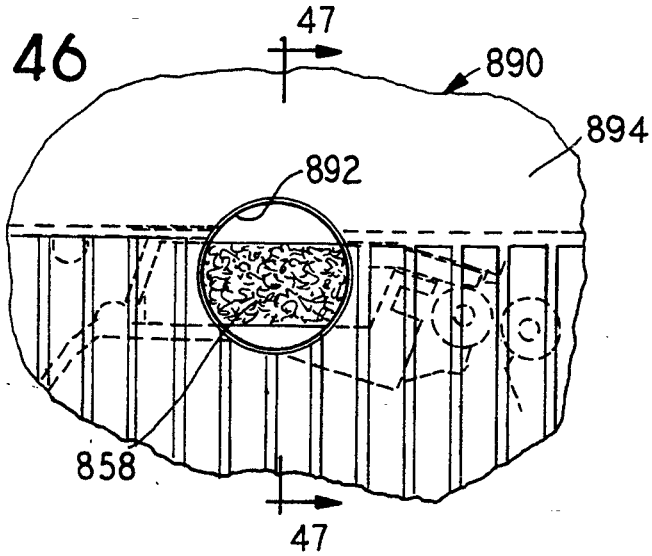
FIG. 46 is a partial bottom view of an alternate ink cartridge of the present invention.
Figure 47:
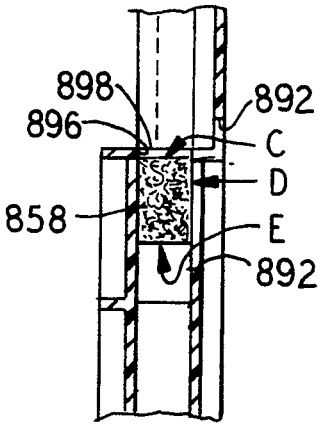
FIG. 47 is a sectional view taken generally along line 47—47 of FIG. 46.

FIG. 46 illustrates another embodiment of an ink cartridge 890 having an aperture 892 formed through a top wall 894 thereof. The aperture 892 has a greater diameter than a width of the ink pad 858. A portion 896 of a side wall 898 is removed also to allow for ink dropping therethrough. In this embodiment of FIGS. 46 and 47, ink can be applied to at least three sides of the pad 858, namely, in the directions C, D and E through the aperture 892.

Figure 49:
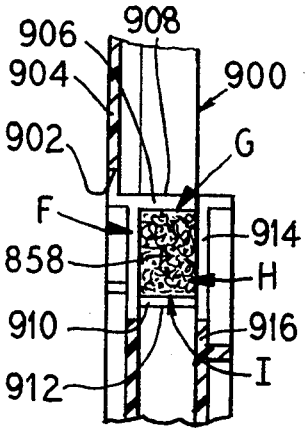
FIG. 49 is a sectional view taken generally along line 49—49 of FIG. 48.
Figure 48:
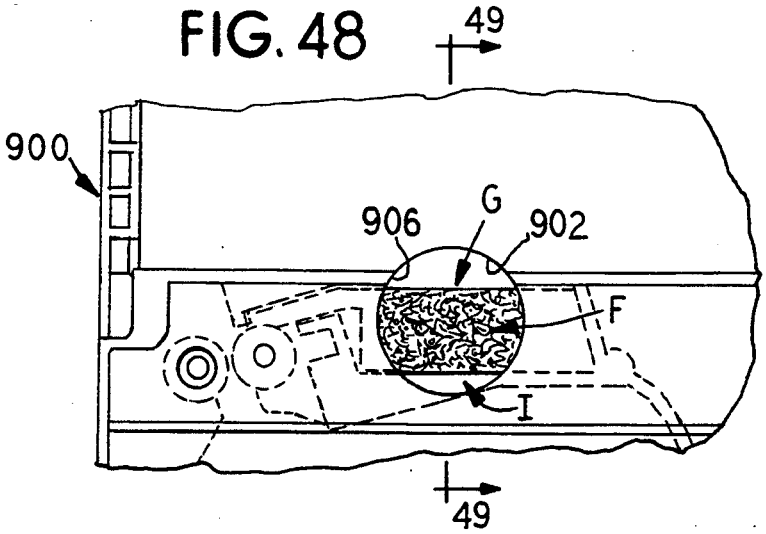
FIG. 48 is a plan view of an alternate ink cartridge of the present invention.

FIGS. 48 and 49 illustrate another embodiment of an ink cartridge 900. In this embodiment, a circular aperture 902 is formed through a top wall 904 of the cartridge. Alternately, a square opening or other shape can be provided. Additionally, a portion 906 is removed from a side wall 908, and a portion 910 is removed from a side wall 912 and a portion 914 is removed from a bottom wall 916. Thus, the ink pad has open access for dropping ink around an entire circumference of the pad 858. Ink can be applied around the circumference of the pad 858 in the directions F, G, H and I. Furthermore, with a square or rectangular pad, openings may be provided in any of the cartridge side walls to provide access to any one of the pad's six sides.

Figure 50:
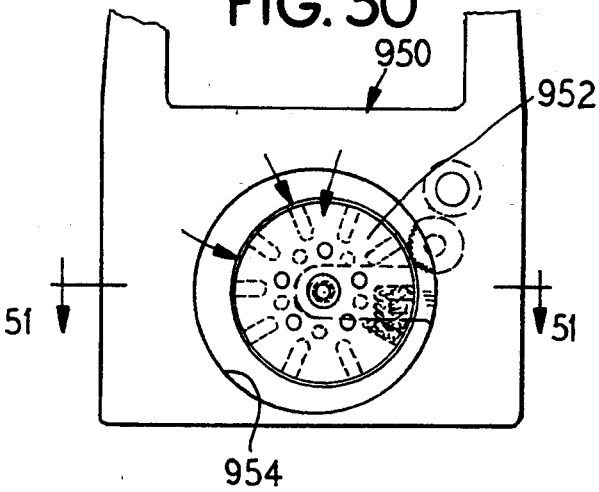
FIG. 50 is a top plan view of an alternate ink cartridge of the present invention.
Figure 51:
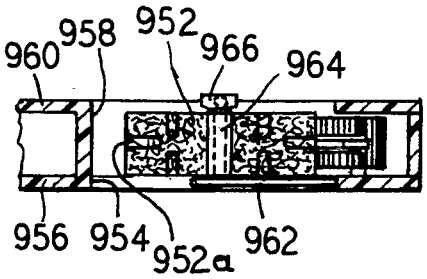
FIG. 51 is a sectional view taken generally along line 51—51 of FIG. 50.

FIGS. 50 and 51 illustrate an additional embodiment of the ink cartridge 950 wherein an ink roller 952 is placed within the cartridge above an aperture 954 in a bottom wall 956 thereof. Above the roller 952 is a top aperture 958 formed through a top wall 960 of the cartridge. A cantilever bracket 962 mounts the axle 964 of the roller 952. A cap 966 is applied onto the axle 964 to hold the roller onto the axle 964. In this embodiment, ink can be added to a top side, bottom side, or around the perimeter of the ink roller 952 to insure complete saturation of the ink roller with ink. Bores **952*a* can be formed through the top side, bottom side and perimeter of the roller 952** to assist in retention and absorption.

Although the present invention has been described with reference to a specific embodiment, those of skill in the art will recognize that changes may be made thereto without departing from the scope and spirit of the invention as set forth in the appended claims.

I claim as my invention:

1. An improved cartridge for a printer, the cartridge having a housing within which is located a coiled ribbon, an ink transfer roller, and an ink retaining mass, the ink transfer roller in flow communication between the ink retaining mass and the ribbon to transfer ink from the ink retaining mass to the ribbon, the improvement comprising:

said ink retaining mass being arranged beneath an opening in the cartridge for dropping ink thereon, and said ink retaining mass composed of a material having pores and includes surface means including an indentation having a depth greater than a depth of one of said pores for holding an accumulation of drops of ink dropped onto said ink retaining mass during absorption of said ink into said ink retaining mass.

2. The improvement according to claim 1, wherein said surface means comprises at least one additional indentation located on a top surface of said mass.

3. The improvement according to claim 1, wherein said indentation comprises an annular groove around a surface of the ink retaining mass.

4. The improvement according to claim 1, wherein said indentation is inclined from a top surface of said mass downwardly, and said surface means comprises at least one additional indentation into the top surface of said mass and inclined in a direction downwardly therefrom.

5. The improvement according to claim 1, wherein said indentation comprises a first dished-out area on a top surface and wherein bottom and side surfaces of said ink retaining mass comprise second and third dished-out areas respectively having depths greater than said depth of one of said pores.

6. The improvement according to claim 1, wherein the cartridge has a base plate with pin receptors for engaging upwardly standing pins provided in the printer upon proper location of the cartridge within the printer, wherein said pin receptors are fashioned as through-holes extending through the base plate of the cartridge.

7. The improvement according to claim 1, wherein said housing defines a walled enclosure for said ink retaining mass, having side walls, a top wall and a bottom wall, and said opening is formed through said top wall and one of said side walls for applying ink to two different surfaces of said ink retaining mass.

8. An improved cartridge according to claim 7 further comprising a second opening in a respective opposite side wall for applying ink to a third surface of said ink retaining mass.

9. An improved cartridge according to claim 8 further comprising a third opening in the bottom wall of the enclosure for applying ink to a floor surface of said ink retaining mass.

10. The improvement according to claim 1, wherein said housing comprises a top wall and a bottom wall and said opening is fashioned as an open through-hole through both said top and bottom walls of said housing and sized to receive said ink retaining mass centrally thereof, said ink retaining mass comprising a roller axially mounted on an axle, said axle held by a bracket cantilevered from said housing into said through-hole.

11. An improved cartridge for a printer, the cartridge having a housing within which is located a coiled ribbon, an ink transfer roller, and an ink retaining mass, the ink transfer roller in flow communication between the ink retaining mass and the ribbon to transfer ink from the ink retaining mass to the ribbon, the improvement comprising:

said ink retaining mass being arranged beneath an opening in the cartridge for dropping ink thereon, and said ink retaining mass includes surface means for holding ink dropped onto said ink retaining mass during absorption of said ink into said ink retaining mass; and wherein said housing has a top wall and said opening is formed through said top wall of said housing; and said ink retaining mass is located within said housing below said opening, and said ink retaining mass comprises a top surface inclined with respect to said top wall of said housing and said top surface has a horizontal orientation.

12. An improved cartridge for a printer, comprising:

a housing within which is located a coiled ribbon, an ink transfer roller, and an ink retaining mass, the ink transfer roller in flow communication between the ink retaining mass and the ribbon to transfer ink from the ink retaining mass to the ribbon;

an axle and a bracket; and an open through-hole through said housing sized to receive said ink retaining mass centrally thereof, said ink retaining mass fashioned as a roller axially mounted on said axle, said axle held by said bracket cantilevered from said housing into said through-hole.

13. An improved cartridge for a printer, comprising:

a housing having a top wall within which is located a coiled ribbon, an ink transfer roller, and an ink retaining mass having a top surface and a side edge, the ink transfer roller in flow communication between the ink retaining mass and the ribbon to transfer ink from the ink retaining mass to the ribbon; and an opening provided through said top wall of said housing, said opening sized to expose a portion of said top surface of said ink retaining mass and a portion of said side edge of said ink retaining mass.

14. An improved cartridge according to claim 13, wherein said opening is sized to expose substantially all of said top surface and substantially all of said side edge.

15. An improved cartridge for a printer, comprising:

an ink retaining mass for holding a supply of ink within the cartridge, the ink retaining mass having indentations on a surface thereof for receiving ink dropped on the ink retaining mass during a refilling operation, said ink retaining mass composed of a material having pores, said indentations greater in depth than one of said pores.

* * * * *